US008857505B2

(12) United States Patent
Beutler et al.

(10) Patent No.: US 8,857,505 B2
(45) Date of Patent: Oct. 14, 2014

(54) STRUCTURED HEAT EXCHANGER TUBE AND METHOD FOR THE PRODUCTION THEREOF

(75) Inventors: Andreas Beutler, Weissenhorn (DE); Jean El Hajal, Ulm (DE); Markus Revermann, Wietmarschen (DE); Andreas Schwitalla, Illerrieden (DE)

(73) Assignee: Wieland-Werke AG, Ulm (DE)

( * ) Notice: Subject to any disclaimer, the term of this patent is extended or adjusted under 35 U.S.C. 154(b) by 748 days.

(21) Appl. No.: 11/702,288

(22) Filed: Feb. 5, 2007

(65) Prior Publication Data

US 2007/0193728 A1 Aug. 23, 2007

(30) Foreign Application Priority Data

Feb. 2, 2006 (DE) ..... 10 2006 008 083

(51) Int. Cl.
*F28F 1/42* (2006.01)
*B21C 37/20* (2006.01)
*F28F 1/40* (2006.01)

(52) U.S. Cl.
CPC ..... *F28F 1/40* (2013.01); *B21C 37/207* (2013.01); *F28F 1/422* (2013.01); *F28F 1/42* (2013.01)
USPC ..... 165/179; 165/184

(58) Field of Classification Search
CPC ..... F28F 1/40; F28F 1/42; F28F 1/422
USPC ..... 165/133, 177, 179, DIG. 515, DIG. 516, 165/DIG. 517, DIG. 529, 183–184; 29/890.046, 890.049
See application file for complete search history.

(56) References Cited

U.S. PATENT DOCUMENTS 3,696,861 A 10/1972 Webb
3,861,462 A 1/1975 McLain (Continued)

FOREIGN PATENT DOCUMENTS

DE 27 58 526 C2 7/1979
DE 101 56 374 C1 2/2003

(Continued)

OTHER PUBLICATIONS

European Patent Office Search Report dated Aug. 6, 2007 (4 pages).

*Primary Examiner* — Tho V Duong
(74) *Attorney, Agent, or Firm* — Flynn, Thiel, Boutell & Tanis, P.C.

(57) ABSTRACT

The invention relates to a heat exchanger tube with at least one structured region on the inside of the tube, which has the following features:

Figure 1:
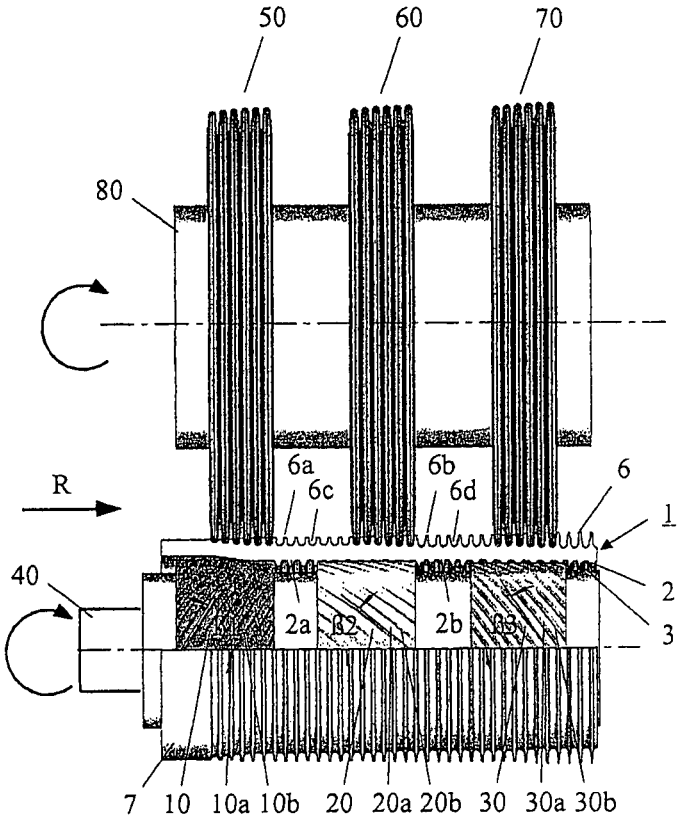

a) integral internal ribs of height H run on the inside of the tube in axially parallel or helical-line-shaped manner continuously over the circumference at an angle of inclination β1, measured with respect to the tube axis, with primary grooves being formed, b) the internal ribs are crossed over the entire circumference of the tube by spaced-apart secondary grooves which, parallel to one another at an angle of inclination β2, measured with respect to the tube axis, have a notch depth T2 and a groove opening angle α2, c) the internal ribs and the secondary grooves are crossed over the entire circumference of the tube by spaced-apart tertiary grooves which run continuously over the circumference parallel to one another at an angle of inclination β3, measured with respect to the tube axis, and have a notch depth T3 and a groove opening angle α3.

A further aspect of the invention relates to a method for producing heat exchanger tubes of this type, with integral external ribs running around the outside of the tube in a helical-line-shaped manner and running on the inside of the tube in an axially parallel or helical-line-shaped manner, and internal ribs which are crossed and notched by secondary grooves and by tertiary grooves.

5 Claims, 5 Drawing Sheets

(56) References Cited

U.S. PATENT DOCUMENTS

| | | | | | |
|---|---|---|---|---|---|
| 3,906,605 | A | * | 9/1975 | McLain | 165/177 |
| 4,216,826 | A | | 8/1980 | Fujikake | |
| 4,330,036 | A | * | 5/1982 | Satoh et al. | 165/179 |
| 4,577,381 | A | | 3/1986 | Sato et al. | |
| 4,660,630 | A | | 4/1987 | Cunningham et al. | |
| 5,054,548 | A | | 10/1991 | Zohler | |
| 5,513,699 | A | | 5/1996 | Menze et al. | |
| 5,697,430 | A | * | 12/1997 | Thors et al. | 165/133 |
| 5,775,411 | A | | 7/1998 | Schuez et al. | |
| 5,992,512 | A | * | 11/1999 | Tsuri et al. | 165/133 |
| 6,056,048 | A | | 5/2000 | Takahashi et al. | |
| 6,098,420 | A | * | 8/2000 | Furukawa et al. | 165/179 |
| 6,336,501 | B1 | * | 1/2002 | Ishikawa et al. | 165/133 |
| 6,488,078 | B2 | * | 12/2002 | Beutler et al. | 165/133 |
| 6,675,881 | B1 | | 1/2004 | Rago | |
| 2002/0033035 | A1 | * | 3/2002 | Zifferer | 72/96 |
| 2002/0195233 | A1 | * | 12/2002 | Thors et al. | 165/133 |
| 2003/0094272 | A1 | | 5/2003 | Brand et al. | |
| 2005/0241150 | A1 | | 11/2005 | Brand et al. | |

FOREIGN PATENT DOCUMENTS

| | | | |
|---|---|---|---|
| EP | 0 607 839 | A1 | 7/1994 |
| EP | 0 713 072 | B1 | 5/1996 |

* cited by examiner

STRUCTURED HEAT EXCHANGER TUBE AND METHOD FOR THE PRODUCTION THEREOF

The present invention relates to a heat exchanger tube with at least one structured region on the inside of the tube, and to a method for the production thereof.

Heat transfer occurs in many areas of refrigeration and air conditioning technology and in process and energy technology. In these fields, tubular heat exchangers are frequently used to transfer heat. In many applications, a liquid flows in this case on the inside of the tube and is cooled or heated depending on the direction of the heat flow. The heat is dispensed to the medium situated on the outside of the tube or is removed therefrom.

It is generally known that structured tubes are used in tubular heat exchangers instead of smooth tubes. The structures improve the passage of heat. The heat flow density is thereby increased and the heat exchanger can be constructed more compactly. Alternatively, the heat flow density can be retained and the operative difference in temperature lowered, thus enabling a more energy-efficient transfer of heat.

Heat exchanger tubes, which are structured on one or both sides, for tubular heat exchangers usually have at least one structured region and smooth end pieces and possibly smooth intermediate pieces. The smooth end or intermediate pieces bound the structured regions. So that the tube can easily be installed in the tubular heat exchanger, the exterior diameter of the structured regions should not be larger than the exterior diameter of the smooth end and intermediate pieces.

Integrally rolled ribbed tubes are frequently used as structured heat exchanger tubes. Integrally rolled ribbed tubes are understood as meaning tubes with a ribbed structure, in which the ribs have been formed from the material of the wall of a smooth tube. In many cases, ribbed tubes, on the inside, have a multiplicity of ribs which are axially parallel or run around in a helical-line-shaped manner and which increase the inner surface area and improve the coefficient of heat transfer on the inside of the tube. On their outer side, the ribbed tubes have ribs running around in an annular or helical manner.

In the past, many possibilities have been developed, depending on the application, to further increase the transfer of heat on the outside of integrally rolled ribbed tubes by the ribs being provided with further structural features on the outside of the tube. As disclosed, for example, in the publication U.S. Pat. No. 5,775,411, for condensation of refrigerants on the outside of the tube, the coefficient of heat transfer is significantly increased if the rib flanks are provided with additional, convex edges. For evaporation of refrigerants on the outside of the tube, it has proven performance-increasing to partially close the channels situated between the ribs, so that cavities are produced which are connected to the surroundings by pores or slots. As already known from numerous publications, such essentially closed channels are produced by bending or folding over the rib (U.S. Pat. Nos. 3,696,861, 5,054,548), by splitting and compressing the rib (DE 2 758 526 C2, U.S. Pat. No. 4,577,381), and by notching and compressing the rib (U.S. Pat. No. 4,660,630, EP 0 713 072 B1, U.S. Pat. No. 4,216,826).

The abovementioned improvements in performance on the outside of the tube have the result that the main portion of the entire heat transfer resistance is displaced to the inside of the tube. This effect occurs in particular in the case of small flow rates on the inside of the tube, such as, for example, during part load operation. In order to significantly reduce the entire heat transfer resistance, it is necessary to further increase the coefficient of heat transfer on the inside of the tube.

In order to increase the heat transfer of the inside of the tube, the internal ribs which are axially parallel or run around in a helical-line-shaped manner can be provided with grooves, as described in the publication DE 101 56 374 C1. In this case, it is of significance that the use disclosed there of profiled roll mandrels for producing the internal ribs and grooves makes it possible to set the dimensions of the internal and of the external structure of the ribbed tube independently of each other. As a result, the structures on the outside and inside can be adapted to the particular requirements and the tube can thus be formed.

Against this background, the object of the present invention is to develop internal structures of heat exchanger tubes of the abovementioned type in such a manner that a further increase in performance is obtained over already known tubes.

In this case, the proportion of the weight of the internal structure in the entire weight of the tube is not to be higher than in the case of conventional, helical-line-shaped internal ribs of constant cross section. Furthermore, a greater increase in the loss of pressure is to be avoided. The dimensions of the internal and of the external structure of the ribbed tube are to be able to be set independently of each other.

The invention is reproduced with regard to a heat exchanger tube by the claimed features with regard to a method for producing a heat exchanger tube by the claimed features. The further claims which are related back concern advantageous developments and improvements of the invention.

The invention includes a heat exchanger tube with at least one structured region on the inside of the tube, which has the following features:

a) integral internal ribs of height H run on the inside of the tube in axially parallel or helical-line-shaped manner continuously over the circumference at an angle of inclination $\beta\mathbf{1}$, measured with respect to the tube axis, with primary grooves being formed, b) the internal ribs are crossed over the entire circumference of the tube by spaced-apart secondary grooves which, parallel to one another at an angle of inclination $\beta\mathbf{2}$, measured with respect to the tube axis, have a notch depth T2 and a groove opening angle $\alpha\mathbf{2}$, c) the internal ribs and the secondary grooves are crossed over the entire circumference of the tube by spaced-apart tertiary grooves which run continuously over the circumference parallel to one another at an angle of inclination $\beta\mathbf{3}$, measured with respect to the tube axis, and have a notch depth T3 and a groove opening angle $\alpha\mathbf{3}$.

The invention is based on the consideration that, in the case of a heat exchanger tube, the internal ribs, which are separated by primary grooves running in parallel, are crossed by secondary grooves. This internal structure is crossed by tertiary grooves which run at an angle of inclination $\beta\mathbf{3}$, measured with respect to the tube axis. In the case of the angles of inclination $\beta\mathbf{1}$, $\beta\mathbf{2}$ and $\beta\mathbf{3}$, it is customary always to name the acute angles with respect to the tube axis. In this context, it follows, for example if angles $\beta\mathbf{2}$ and $\beta\mathbf{3}$ are identical in terms of magnitude, that a crossed internal structure is constructed by the secondary and tertiary grooves running around it in opposite directions. When secondary and tertiary grooves run around it in the same direction, the angles $\beta\mathbf{2}$ and $\beta\mathbf{3}$ consequently differ in magnitude. In addition, the secondary and tertiary grooves can differ in at least one of the following features: notch depth T, pitch P, groove opening angle $\alpha$.

The depth T of the secondary and tertiary grooves is measured in the radial direction from the tip of the internal rib. The pitch P is the shortest distance between adjacent, parallel grooves produced by the same mandrel, and is a measure of the separation of the ribs. The groove opening angle $\alpha$ is the angle of the grooves present on the profiled mandrel with which the secondary and tertiary grooves of the internal ribbed structure are produced.

The particular advantage is that, by inserting the tertiary grooves, an internal structure of singly notched internal ribs with a helix-shaped superlattice structure is produced. As a result, additional eddies are forced on the fluid flowing through the tube, which leads to a further increase in the internal transfer of heat. This increase in performance exceeds the influence of the loss of pressure which increases as a consequence of the formation of eddies. It is clear that the addition of tertiary grooves by simple displacement of the material does not increase the proportion of the weight of the internal structure in the entire weight of the tube. The proportion of the weight of the internal structure in the entire weight of the tube is therefore not higher than in the case of conventional, helical-line-shaped internal ribs of constant cross section.

In a preferred refinement of the invention, the structured region on the inside of the tube can differ in the pitch P2 of the secondary grooves and pitch P3 of the tertiary grooves. The helix-shaped superlattice structure is thereby formed. It is furthermore preferred that the pitch P2 of the secondary grooves is smaller than the pitch P3 of the tertiary grooves. The secondary grooves are therefore situated closer together than the tertiary grooves, as a result of which the effect on the formation of eddies can be adapted in accordance with the fluid used and in particular the viscosity thereof.

In a preferred development of the invention, the structured region on the inside of the tube can differ in the groove opening angle $\alpha$2 of the secondary grooves and $\alpha$3 of the tertiary grooves. The inclinations of the rib flanks structured by the secondary and tertiary grooves are therefore influenced in particular. The angle of inclination of the flanks substantially influences the flow behavior of the fluid passed through during operation.

The structured region on the inside of the tube can preferably differ in the notch depth T2 of the secondary grooves and T3 of the tertiary grooves. In this case, in the structured region on the inside of the tube, the notch depth T2 of the secondary grooves can be smaller than the notch depth T3 of the tertiary grooves. This primarily enables the integral internal ribs, which are notched by the secondary grooves, to be overstamped.

Integral external ribs can advantageously run around the outside of the tube in an axially parallel or helical-line-shaped manner. For this case, a further aspect of the invention includes a method for producing a structured heat exchanger tube, with integral external ribs, i.e. machined from the tube wall, running around the outside of the tube in a helical-line-shaped manner and running on the inside of the tube in an axially parallel or helical-line-shaped manner, and internal ribs which are crossed and notched by secondary grooves and by tertiary grooves, in which the following method steps are carried out:

a) in a first forming region, external ribs running in a helical-line-shaped manner are formed on the outside of a smooth tube by the rib material being obtained by displacement of material from the tube wall by means of a first rolling step and the ribbed tube produced being caused to rotate by the rolling forces and being pushed forwards in accordance with the helical-line-shaped ribs produced, the external ribs being formed with a rising height from the otherwise undeformed smooth tube, b) in the first forming region, the tube wall is supported by a first roll mandrel which is situated in the tube, is mounted rotatably and is profiled, as a result of which the internal ribs are constructed, c) in a second rolling step, the external ribs are constructed in a second forming region spaced apart from the first forming region, with a further rising height, and the internal ribs are provided with secondary grooves, the tube wall being supported in the second forming region by a second roll mandrel which is situated in the tube, is likewise of rotatable and profiled design, but the profiling of which differs from the profiling of the first roll mandrel with regard to the magnitude or the orientation of the angle of twist, d) in a third rolling step, the external ribs are constructed in a third forming region spaced apart from the second forming region, with a further rising height, and the internal ribs are provided with tertiary grooves, the tube wall being supported in the third forming region by a third roll mandrel which is situated in the tube, is likewise of rotatable and profiled design, but the profiling of which differs from the profiling of the first roll mandrel and of the second roll mandrel with regard to the magnitude and/or orientation of the angle of twist.

The invention with respect to the method of production is based on the consideration that, in order to produce a structured heat exchanger tube with the proposed tertiary grooves in the internal ribs provided with secondary grooves, the roll tool for forming the external ribs is constructed in at least three spaced-apart roll disk assemblies. These roll disk assemblies produce external ribs running around in a helical manner and at the same time ensure that the tube is pushed forwards, which is required for the structuring operation. The internal structure is formed by three differently profiled roll mandrels. The first roll mandrel supports the tube in the forming region below the first roll disk assembly and first of all forms axially parallel internal ribs or internal ribs which run around in a helical-line-shaped manner, these internal ribs initially having a constant cross section. The second roll mandrel supports the tube in the forming region below the second roll disk assembly of larger diameter and forms the secondary grooves in the previously formed axially parallel ribs or ribs which run around helically. The third roll mandrel under the third roll disk assembly produces the tertiary grooves in the previously produced internal structure comprising the singly notched ribs. The depths of the secondary and tertiary grooves are essentially defined by the selection of the diameters of the three roll mandrels.

The advantages of the invention that have already been mentioned with regard to the heat exchanger tubes are added to by further advantages through the method of production by the dimensions, which are obtained with the different roll tools, of the internal and the external structure of the ribbed tube being able to be set independently of one another. Thus, for optimum passage of heat, the internal and the external structure can be optimally coordinated with each other.

Essentially an integral multiple of the separation of the external ribs can preferably be set as the distance between the forming regions.

In an advantageous refinement of the invention, the external diameter of the second roll mandrel can be selected to be smaller than the external diameter of the first roll mandrel. The external diameter of the third roll mandrel can advantageously also be selected to be smaller than the external diameter of the second roll mandrel. With this graduation of the diameters of the roll mandrels, the stamping operation in the radial direction is ensured.

In a further preferred embodiment, the depths T2 and T3 of the secondary grooves and tertiary grooves can be set by selection of the diameters of the roll mandrels and by selection of the diameters of the respectively largest roll disks of the three roll tools. This shows that the entire material flow on the inside and outside of the tube can be optimized by corresponding use of the exterior roll tools and the interior roll mandrels.

Figure 2:
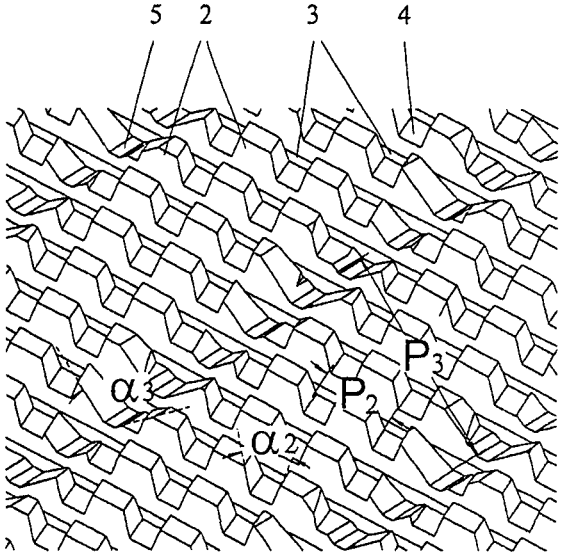
Figure 3:
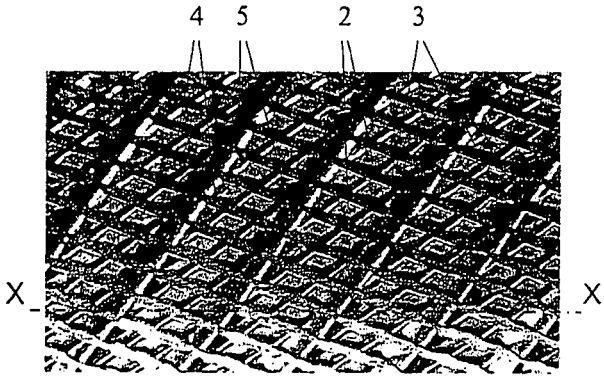
Figure 4:
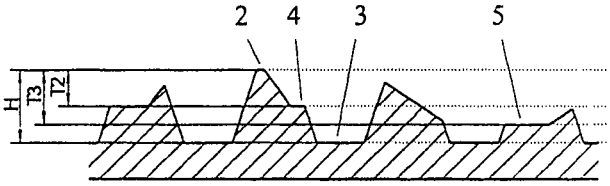
Figure 5:
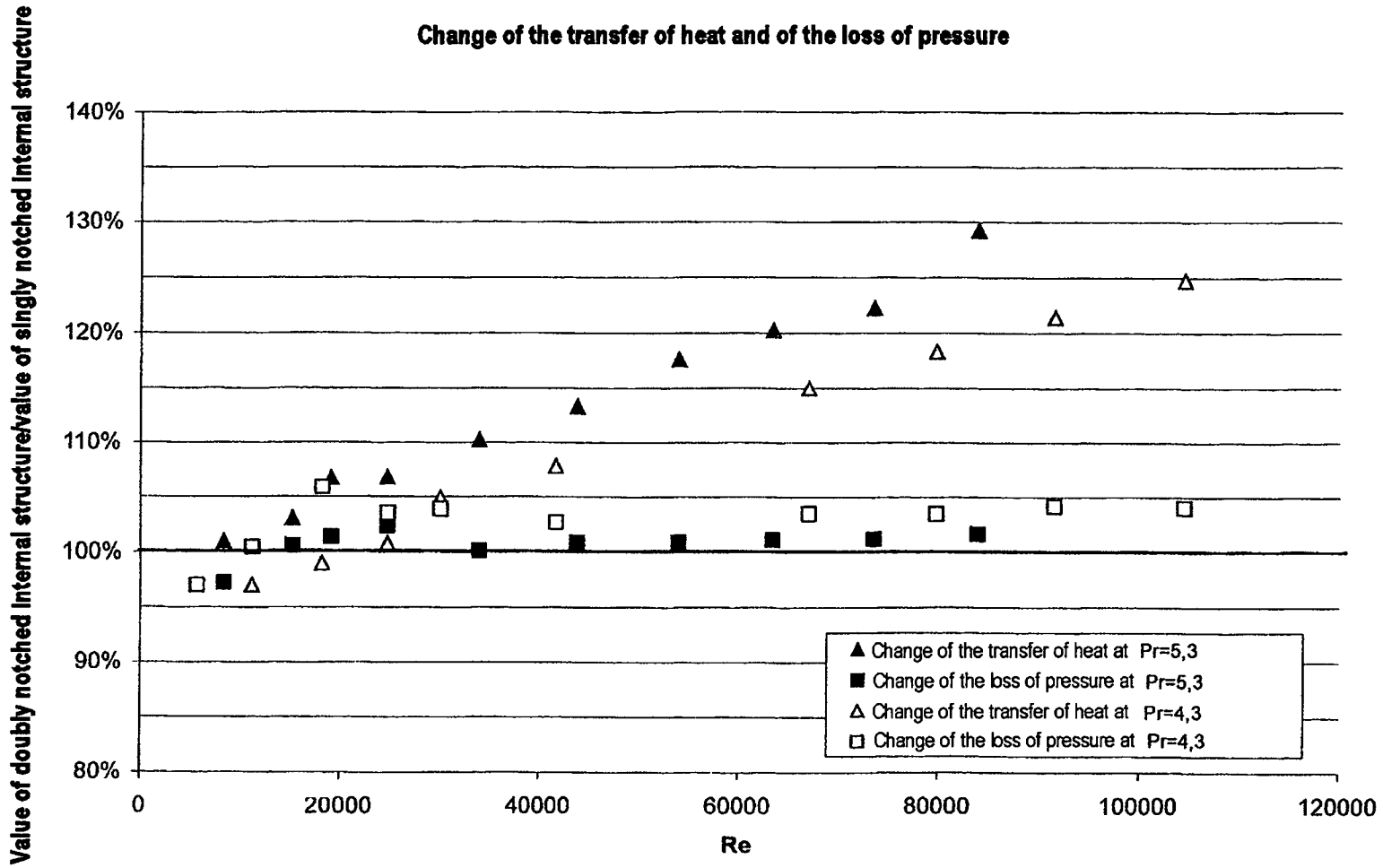

Further advantages and refinements of the invention are explained in more detail with reference to schematic drawings, in which:

FIG. 1 shows, schematically, the production of a heat exchanger tube according to the invention by means of three mandrels with differing twist and differing separation, FIG. 2 shows a schematic partial view of the internal structure produced, FIG. 3 shows a photo of an internal structure, FIG. 4 shows, schematically, part of the section through the internal structure from FIG. 3 along the line X-X, and FIG. 5 shows a diagram which shows the improvement via the Reynolds' number of the internal heat transfer over the singly notched internal ribs. Furthermore, the ratio of the losses of pressure from the novel internal structure in comparison to the internal structure without tertiary grooves is illustrated.

Figure 6:
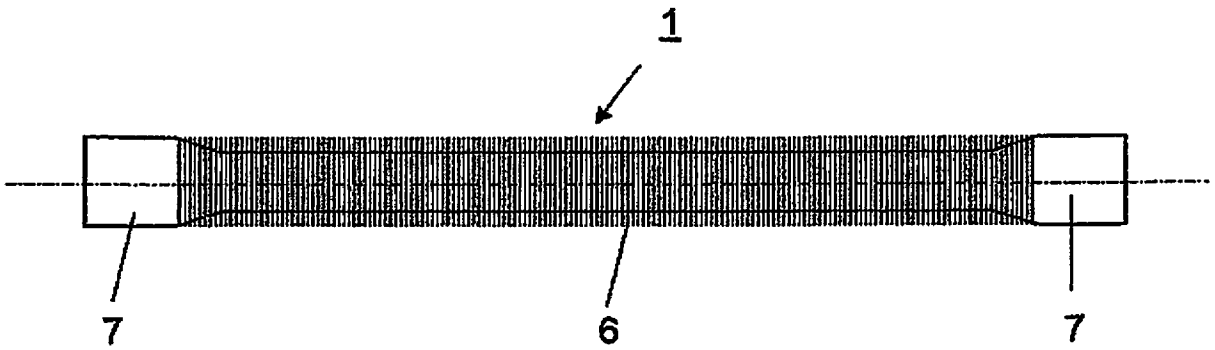

FIG. 6 shows an integrally rolled heat exchanger tube according to the present invention having a structured region with external ribs and plain end pieces delimiting the structured region.

Mutually corresponding parts are provided with the same reference numbers in all of the figures.

The integrally rolled ribbed tube 1 has external ribs 6 running around the outside of the tube continuously over the circumference in a helical-line-shaped manner. The production of the ribbed tube according to the invention takes place by a rolling operation by means of the roll device illustrated in FIG. 1.

A device is used which comprises n=3 or 4 tool holders 80 in which in each case at least three spaced-apart roll tools with roll disks 50, 60 and 70 are integrated. For clarity reasons, only one tool holder 80 is illustrated in FIG. 1.

The axis of a tool holder 80 is at the same time the axis of the three associated roll tools 50, 60 and 70, said axis running obliquely with respect to the tube axis. The tool holders 80 are in each case offset on the circumference of the ribbed tube 1 by 360°/n. The tool holders 80 can be adjusted radially with respect to the tube. They are arranged for their part in a positionally fixed roll head (not illustrated). The roll head is fixed in the basic framework of the roll device. The roll tools 50, 60 and 70 in each case comprise a plurality of roll disks which are arranged next to one another and the diameter of which rises in the rolling direction R. Consequently, the roll disks of the second roll tool 60 have a larger diameter than the roll disks of the first roll tool 50, and the roll disks of the third roll tool 70 in turn have a larger diameter than the roll disks of the second roll tool 60.

Three profiled roll mandrels 10, 20 and 30 with the aid of which the internal structure of the tube is produced, are likewise part of the device. The roll mandrels 10, 20 and 30 are fitted at the free end of a roll mandrel rod 40 and are mounted rotatably with respect to one another. The roll mandrel rod 40 is fastened at its other end to the basic framework of the roll device. The roll mandrels 10, 20 and 30 are to be positioned in the working region of the roll tools 50, 60 and 70. The roll mandrel rod 40 has to be at least as long as the ribbed tube 1 to be produced. Prior to the machining operation, the smooth tube 7, with the roll tools 50, 60 and 70 not advanced, is pushed virtually entirely over the roll mandrels 10, 20 and 30 onto the roll mandrel rod 40. Only that part of the smooth tube 7 which is intended to form the first smooth end piece of the finished ribbed tube 1 is not pushed over the roll mandrels 10, 20 and 30.

In order to machine the tube, the rotating roll tools 50, 60 and 70, which are arranged on the circumference, are advanced radially to the smooth tube 7 and brought into engagement therewith. This causes the smooth tube 7 to rotate. Since the axis of the roll tools 50, 60 and 70 is positioned obliquely with respect to the tube axis, the roll tools 50, 60 and 70 form external ribs 6, which run around in a helical-line-shaped manner, from the tube wall of the smooth tube 7 and at the same time push the ribbed tube 1 produced forwards in the rolling direction R in accordance with the inclination of the external ribs 6 running around it in a helical-line-shaped manner. The external ribs 6 preferably run around it in the manner of a multiple-start thread. The distance, measured longitudinally with respect to the tube axis, between the centers of two adjacent external ribs 6 is referred to as the separation of the ribs. The distances between the three roll tools 50, 60 and 70 have to be adapted in such a manner that the roll disks of the following roll tool 60 or 70 engage in the grooves 6*c* or 6*d* which are between the ribs 6*a* or 6*b* formed by the previous roll tool 50 or 60. These distances are ideally an integral multiple of the separation of the external ribs. The following roll tool 60 or 70 then continues the further forming of the external ribs 6*a* or 6*b*.

In the forming zone of the first roll tool 50, the tube wall is supported by a first profiled roll mandrel 10 and, in the forming zone of the second roll tool 60, the tube wall is supported by a second profiled roll mandrel 20 and, in the forming zone of the third roll tool 70, the tube wall is supported by the third profiled roll mandrel 30. The axes of the three roll mandrels 10, 20 and 30 are identical to the axis of the ribbed tube 1. The profiles of the roll mandrels 10, 20 and 30 differ. The external diameter of the second roll mandrel 20 is at most the same size as the external diameter of the first roll mandrel 10. The external diameter of the third roll mandrel 30 is in turn at most the same size as the external diameter of the second mandrel 20. The external diameter of the second roll mandrel 20 is typically up to 0.8 mm smaller than the external diameter of the first roll mandrel 10, and the external diameter of the third roll mandrel 30 is preferably up to 0.5 mm smaller than the external diameter of the second roll mandrel 20. The profile of the roll mandrels 10, 20 and 30 usually comprises a multiplicity of trapezoidal grooves 10*b*, 20*b* and 30*b* which are arranged parallel to one another on the outer surface of the mandrel. The roll mandrel material which is situated between two adjacent grooves 10*b*, 20*b* and 30*b* is referred to as the web 10*a*, 20*a* or 30*a*. The webs 10*a*, 20*a* or 30*a* have an essentially trapezoidal cross section. The opening angles of the grooves are denoted by $\alpha 2$ in the case of mandrel 20 and by $\alpha 3$ in the case of mandrel 30. The grooves 10*b* and 20*b* of the first and second roll mandrels 10 and 20 usually run at an inclination with respect to the axis of the mandrel at an angle of 0° to 70°. The grooves 30*b* of the third roll mandrel 30 generally run at an angle of 10° to 80°. In the case of the first roll mandrel 10, this angle is denoted by $\beta 1$, in the case of the second roll mandrel 20 by $\beta 2$ and, in the case of the third roll mandrel 30, this angle is denoted by $\beta 3$. The angle 0° corresponds to the situation in which the grooves 10*b*, 20*b* or 30*b* run parallel to the axis of the roll mandrels 10, 20 or 30. If the angle differs from 0°, the grooves 10*b*, 20*b* or 30*b* run in a helical-line-shaped manner. Grooves running in a helical-line-shaped manner can be oriented in a left-handed or right-handed manner. FIG. 1 illustrates the situation in which the first roll mandrel 10 has left-handed grooves 10*b*, and the second and the third roll mandrels 20 and 30 have right-handed grooves 20*b* and 30*b*.

The internal structure produced therewith is illustrated in FIG. 2 using a schematic partial view. In this case, the depth T3 of the tertiary grooves 5 is greater than the depth T2 of the secondary grooves 4. The directions in which the secondary grooves 4 and tertiary grooves 5 are twisted differ in magnitude but not in direction.

In FIG. 3, with reference to a photograph of an internal structure, in which the depth T3 of the tertiary grooves 5 is greater than the depth T2 of the secondary grooves 4, the angles of twist of the secondary grooves 4 and tertiary grooves 5 are in the same direction but they differ in their magnitude.

For the roll mandrels with orientation in the same direction, the corresponding angles of inclination β1, β2 or β3 of the mandrels 10, 20 or 30 have to differ. The three roll mandrels 10, 20 and 30 are mounted rotatably with respect to one another.

The material of the tube wall is pressed into the grooves 10*b* of the first roll mandrel 10 by the radial forces of the first roll tool 50. By this means, internal ribs 2*a* running around continuously over the circumference in a helical-line-shaped manner are formed on the inner surface of the ribbed tube 1. Primary grooves 3 run between two adjacent internal ribs 2*a*. In accordance with the shape of the grooves 10*b* of the first roll mandrel 10, the internal ribs 2*a* have a trapezoidal cross section which initially remains constant along the internal rib 2*a*. The internal ribs 2*a* are inclined with respect to the tube axis by the same angle β1 as the grooves 10*b* are inclined with respect to the axis of the first roll mandrel 1. The height of the finished structure of the internal ribs 2 is denoted by H and is usually 0.15-0.60 mm.

The internal ribs 2*a* are pressed onto the second roll mandrel 20 by the radial forces of the second roll tool 60. Since the grooves 20*b* of the second roll mandrel 20 run at a different angle with respect to the mandrel axis and therefore at a different angle with respect to the tube axis than the grooves 10*b* of the first roll mandrel 10, the internal ribs 2*a* meet a groove 20*b* or a web 20*a* of the second roll mandrel 20 in some sections. In the sections in which an internal rib 2*a* meets a groove 20*b*, the material of the internal rib 2*a* is pressed into the groove 20*b*. In the sections in which an internal rib 2*a* meets a web 20*a*, the rib material is deformed and secondary grooves 4, which run parallel to one another and run continuously over the circumference, are pressed into the internal ribs. The secondary grooves 4 have a groove opening angle which corresponds to the opening angle α2 of the second roll mandrel. The distance between the secondary grooves 4 is referred to as pitch P2. In accordance with the shape of the webs 20*a* of the second roll mandrel 20, the secondary grooves 4 have a trapezoidal cross section. Secondary grooves 4 which are pressed into different internal ribs by the same web 20*a* are arranged in alignment with one another. The angle which the secondary grooves 4 form with the tube axis is identical to the angle β2 which the grooves 20*b* of the second roll mandrel 20 enclose with the axis of the second roll mandrel 20.

The singly notched internal ribs 2*b* are pressed onto the third mandrel 30 by the radial forces of the third roll tool 70. Since the geometry of the third roll mandrel 30 differs from the geometries of the first two mandrels 10 and 20, some sections of the singly notched ribs 2*b* meet a groove 30*b* or a web 30*a* of the third roll mandrel 30. In the sections in which the singly notched internal rib 2*b* meets a web 30*a*, the material of the singly notched internal rib 2*b* is deformed, and tertiary grooves 5, which run parallel to one another and run continuously over the circumference, are formed, into which singly notched internal ribs 2*b* are pressed. The tertiary grooves 5 have a groove opening angle which corresponds to the opening angle α3 of the third roll mandrel 30. The distance between the tertiary grooves 5 is referred to as pitch P3. In accordance with the shape of the webs 30*a* of the third roll mandrel 30, the tertiary grooves 5 have a trapezoidal cross section. Owing to the separation of the third mandrel 30, which is greater than the separation of the first two roll mandrels 10 and 20, a helix-shaped superlattice structure is produced by the tertiary grooves 5. The angle which the tertiary grooves 5 form with the tube axis is equal to the angle β3.

The depths T2 and T3 of the secondary and tertiary grooves 4 and 5 are measured in the radial direction from the tip of the internal rib 2. Suitable selection of the external diameters of the roll mandrels 10, 20 and 30, and suitable selection of the external diameters of the respectively largest roll disks of the three roll tools 50, 60 and 70 enable the depths T2 and T3 of the secondary and tertiary grooves 4 and 5 to be varied: the smaller the difference in the external diameter between two adjacent roll mandrels 10 and 20 or 20 and 30, the greater is the notch depth of the grooves 4 or 5 produced by the following roll mandrel 20 or 30. However, a change of the external diameter of one of the three roll mandrels 10, 20 or 30 not only results in a change of the notch depth T2 or T3 of the secondary or tertiary grooves 4 or 5 but usually also causes a change of the height of the external ribs 6. However, this effect can be compensated for by modifying the construction of the roll tools 50, 60 and 70. In particular, the diameters of the last roll disks in one of the roll tools 50, 60 and 70 can be adapted for this purpose.

In order to significantly influence the flow of liquid flowing in the tube, the depth T2 of the secondary grooves 4 should be at least 20% of the height H of the internal ribs 2, and the depth of the tertiary grooves T3 should be at least 20% of the height H. T3 is preferably larger than T2.

FIG. 4 shows schematically a section through the internal structure of FIG. 3 along the line X-X. The height ratios between internal ribs 2, primary grooves 3, secondary grooves 4 and tertiary grooves 5 are clearly apparent here.

The internal structure of the ribbed tube 1 is provided with additional edges by means of the secondary grooves 4. If liquid flows on the inside of the tube, then additional eddies arise in the liquid at these edges and improve the transfer of heat to the tube wall. The tertiary grooves 5 produce a helix-shaped superlattice structure, as a result of which additional eddies are produced in the flow of liquid. These additional eddies result in a further increase in the internal transfer of heat.

The description of the method of production according to the invention shows that the dimensions of the external and internal structure can be set independently of one another with wide ranges because of the multiplicity of tool parameters which can be selected in this method. In particular, the division of the roll tool of the three spaced-apart roll tools 50, 60 and 70 makes it possible to vary the depths T2 and T3 of the secondary grooves 4 and tertiary grooves 5 without changing the height of the external ribs 6 at the same time.

Ribbed tubes which are structured on both sides and are intended for refrigeration and air conditioning technology are frequently produced from copper or copper nickel. Since, in the case of these metals, just the cost of the material causes a not inconsiderable portion of the overall costs of the ribbed tube, it is advantageous that, with the tube diameter given, the weight of the tube is as low as possible. In the case of commercially available ribbed tubes nowadays, the proportion of the weight of the internal structure in the entire weight is 10% to 20% depending on the height of the internal structure and therefore depending on the performance capability. The tertiary grooves 5 according to the invention in the simply notched internal ribs of ribbed tubes 1 structured on both sides make it possible to considerably increase the performance capability of such tubes without the proportion of the weight of the internal structure being increased.

FIG. 5 shows a diagram which documents the performance advantage of the internal structure according to the invention. The improvement of the internal transfer of heat of the internal structure according to the invention over the only singly notched internal structure is plotted over the Reynolds' number during the flow of water. In the case of both tubes, the height of the internal ribs is approximately 0.3 mm. The geometry of the first and second mandrel used is identical in both internal structures. The ribbed tube with the doubly notched internal structure has an advantage with regard to the internal transfer of heat in the Reynolds' range of 20 000 to 60 000 of 8% to 20%.

FIG. 6 illustrates an embodiment of the present invention where an integrally rolled heat exchanger tube 1 has a structured region with external ribs 6 and plain end pieces 7 in which the external diameter of the structured region is not larger than the exterior diameter of the smooth end pieces.

List Of Designations

1 Heat exchanger tube/ribbed tube
2 Internal ribs
2*a* Internal ribs after first roll mandrel
2*b* Internal ribs after second roll mandrel
3 Primary grooves
4 Secondary grooves
5 Tertiary grooves
6 External ribs
6*a* External ribs after first roll tool
6*b* External ribs after second roll tool
6*c* Grooves of the external ribbed structure after first roll tool
6*d* Grooves of the external ribbed structure after second roll tool
7 Smooth tube
10 First roll mandrel
10*a* Webs of the first roll mandrel
10*b* Grooves of the first roll mandrel
20 Second roll mandrel
20*a* Webs of the second roll mandrel
20*b* Grooves of the second roll mandrel
30 Third roll mandrel
30*a* Webs of the third roll mandrel
30*b* Grooves of the third roll mandrel
40 Roll mandrel rod
50 First roll tool with roll disks
60 Second roll tool with roll disks
70 Third roll tool with roll disks
80 Tool holder
$\alpha$2 Groove opening angle of the secondary grooves
$\alpha$3 Groove opening angle of the tertiary grooves
$\beta$1 Angle of inclination of the internal ribs
$\beta$2 Angle of inclination of the secondary grooves
$\beta$3 Angle of inclination of the tertiary grooves
H Height of the internal ribs
T2 Notch depth of the secondary grooves
T3 Notch depth of the tertiary grooves
P Separation of the internal grooves
P2 Separation of the secondary grooves
P3 Separation of the tertiary grooves
R Rolling direction specified by arrow

The invention claimed is:

1. An integrally rolled heat exchanger tube comprising:

at least one structured region on an outside of the tube having integrally rolled external ribs extending in a helical-line-shaped manner;

at least one structured region on an inside of the tube comprising:

primary grooves that form integral internal ribs which extend along the inside of the tube in an axially parallel or helical-line-shaped manner continuously over the circumference of the tube, said internal ribs having a height which ranges from 0.15 to 0.60 mm;

secondary grooves which are spaced-apart and parallel to one another and which cross the integral internal ribs over the entire circumference of the tube, the secondary grooves having a pitch;

tertiary grooves which extend continuously over the circumference of the tube, are parallel to one another, and cross the integral internal ribs and the secondary grooves over the entire circumference of the tube, the tertiary grooves having a pitch, wherein the pitch of the secondary grooves is smaller than the pitch of the tertiary grooves, and wherein an internal structure of singly-notched internal ribs with a helix-shaped superlattice structure is produced by insertion of the tertiary grooves; and smooth end pieces delimiting the structured regions, wherein the exterior diameter of the structured regions is not lager than the exterior diameter of the smooth end pieces, wherein the secondary and tertiary grooves have a notch depth, the notch depth of the secondary grooves being less than the notch depth of the tertiary grooves.

2. The heat exchanger tube according to claim 1, wherein the secondary grooves have an opening angle, and the tertiary grooves have an opening angle, the opening angle of the secondary grooves being different than the opening angle of the tertiary grooves.

3. A heat exchanger, comprising:

a tube comprising an inner surface, the inner surface defining therein primary grooves, secondary grooves, and tertiary grooves, the secondary grooves having a pitch and the tertiary grooves having a pitch, the pitch of the secondary grooves being smaller than the pitch of the tertiary grooves, wherein the secondary grooves cross the primary grooves, and the tertiary grooves cross the secondary grooves, creating an internal helical rib structure on the inner surface of the tube, wherein the secondary and tertiary grooves have a notch depth, the notch depth of the secondary grooves being less than the notch depth of the tertiary grooves.

4. The heat exchanger of claim 3, wherein the secondary grooves have an opening angle and the tertiary grooves have an opening angle, the opening angle of the secondary grooves being different than the opening angle of the tertiary grooves.

5. The heat exchanger of claim 3, further comprising integral external ribs extending around an outside of the tube in an axially parallel or helical-line-shaped manner.

* * * * *

UNITED STATES PATENT AND TRADEMARK OFFICE

CERTIFICATE OF CORRECTION

PATENT NO. : 8,857,505 B2
APPLICATION NO. : 11/702288
DATED : October 14, 2014
INVENTOR(S) : Andreas Beutler et al.

It is certified that error appears in the above-identified patent and that said Letters Patent is hereby corrected as shown below:

On the title page, the date under item (30) is incorrect. Please change item (30) to read as follows:

(30) Foreign Application Priority Data

Feb. 22, 2006 (DE) ..... 10 2006 008 083

Signed and Sealed this
Seventeenth Day of February, 2015

Michelle K. Lee

Michelle K. Lee
*Deputy Director of the United States Patent and Trademark Office*